US005222190A

United States Patent [19]

Pawate et al.

[11] Patent Number: 5,222,190

[45] Date of Patent: Jun. 22, 1993

[54] APPARATUS AND METHOD FOR IDENTIFYING A SPEECH PATTERN

[75] Inventors: Basavaraj I. Pawate, Dallas; George R. Doddington, Richardson, both of Tex.

[73] Assignee: Texas Instruments Incorporated, Dallas, Tex.

[21] Appl. No.: 713,481

[22] Filed: Jun. 11, 1991

[51] Int. Cl.[5] ..... G10L 9/00

[52] U.S. Cl. ..... 395/2

[58] Field of Search ..... 381/41-47; 395/2

[56] References Cited

U.S. PATENT DOCUMENTS

| | | | |
|---|---|---|---|
| 4,672,668 | 6/1987 | Kitazume et al. | 381/43 |
| 4,696,042 | 9/1987 | Goudie | 381/41 |
| 4,794,645 | 12/1988 | Watari | 381/43 |
| 4,821,325 | 4/1989 | Martin et al. | 381/41 |
| 5,109,418 | 4/1992 | Van Hemert | 381/41 |

*Primary Examiner*—Michael R. Fleming
*Assistant Examiner*—Michelle Doerrler
*Attorney, Agent, or Firm*—Frank J. Kowalski; Leo N. Heiting; Richard L. Donaldson

[57] ABSTRACT

A method and apparatus are provided for identifying one or more boundaries of a speech pattern within an input utterance. One or more anchor patterns are defined, and an input utterance is received. An anchor section of the input utterance is identified as corresponding to at least one of the anchor patterns. A boundary of the speech pattern is defined based upon the anchor section. Also provided are a method and apparatus for identifying a speech pattern within an input utterance. One or more segment patterns are defined, and an input utterance is received. Portions of the input utterance which correspond to the segment patterns are identified. One or more of the segments of the input utterance are defined responsive to the identified portions.

62 Claims, 3 Drawing Sheets

APPARATUS AND METHOD FOR IDENTIFYING A SPEECH PATTERN

TECHNICAL FIELD OF THE INVENTION

This invention relates in general to speech processing methods and apparatus, and more particularly relates to methods and apparatus for identifying a speech pattern.

BACKGROUND OF THE INVENTION

Speech recognition systems are increasingly utilized in various applications such as telephone services where a caller orally commands the telephone to call a particular destination. In these systems, a telephone customer may enroll words corresponding to particular telephone numbers and destinations. Subsequently, the customer may pronounce the enrolled words, and the corresponding telephone numbers are automatically dialled. In a typical enrollment, input utterance is segmented, word boundaries are identified, and the identified words are enrolled to create a word model which may be later compared against subsequent input utterances. In subsequent speech recognition, the input utterance is compared against enrolled words. Under a speaker-dependent approach, the input utterance is compared against words enrolled by the same speaker. Under a speaker-independent approach, the input utterance is compared against words enrolled to correspond with any speaker.

Many prior art systems falsely incorporate noise as part of a word. Another major problem in speech enrollment and recognition systems is the false classification of a word portion as being noise. Typical enrollment and speech recognition approaches rely upon frame energy as the primary means of identifying word boundaries and of segmenting an input utterance into words. However, the frame energy approach frequently excludes low energy portions of a word. Hence, words are inaccurately delineated, and subsequent recognition suffers. Moreover, in frame energy-based systems, all words must typically be enunciated in isolation which is undesirable if several words or phrases must be enrolled or recognized. Even if frame energy is not used to segment words in the subsequent speech recognition process, the accuracy of speech recognition will depend upon the accuracy of prior speech enrollment which typically does rely upon frame energy.

Therefore, a need has arisen for an accurate method and apparatus for identifying a speech pattern.

SUMMARY OF THE INVENTION

In a first aspect of the present invention, a method and apparatus are provided for identifying one or more boundaries of a speech pattern within an input utterance. One or more anchor patterns are defined, and an input utterance is received. An anchor section of the input utterance is identified as corresponding to at least one of the anchor patterns. A boundary of the speech pattern is defined based upon the anchor section.

It is a technical advantage of this aspect of the invention that word boundaries are accurately identified.

In a second aspect of the present invention, a method and apparatus are provided for identifying a speech pattern within an input utterance. One or more segment patterns are defined, and an input utterance is received. Portions of the input utterance which correspond to the segment patterns are identified. One or more of the segments of the input utterance are defined responsive to the identified portions.

It is a technical advantage of this aspect of the present invention that a speech pattern within an input utterance is accurately identified.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE INVENTION

The preferred embodiment of the present invention and its advantages are best understood by referring to FIGS. 1–6 of the drawings, like numerals being used for like and corresponding parts of the various drawings.

Figure 1:
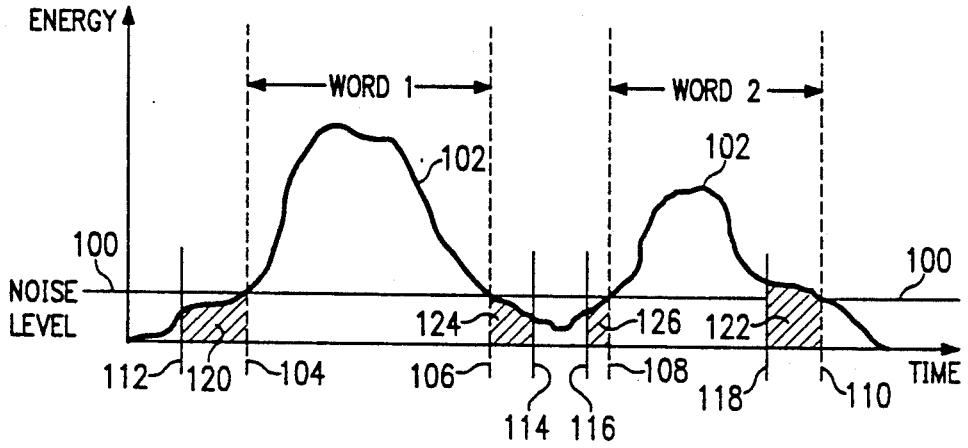
FIG. 1 illustrates a problem addressed by the present invention.

FIG. 1 illustrates a speech enrollment and recognition system which relies upon frame energy as the primary means of identifying word boundaries. In FIG. 1, a graph illustrates frame energy versus time for an input utterance. A noise level threshold 100 is established to identify word boundaries based on the frame energy. Energy levels that fall below threshold 100 are ignored as noise. Under this frame energy approach, word boundaries are delineated by points where the frame energy curve 102 crosses noise level threshold 100. Thus, word-1 is bounded by crossing points 104 and 106 Word-2 is bounded by crossing points 108 and 110.

Frequently, the true boundaries of words in an input utterance are different from word boundaries identified by points where energy curve 102 crosses noise level threshold 100. For example, the true boundaries of word-1 are located at points 112 and 114. The true boundaries of word-2 are located at points 116 and 118. Portions of energy curve 102, such as shaded sections 120 and 122, are especially likely to be erroneously included or excluded from a word.

Consequently, word-1 has true boundaries at points 112 and 114, yet shaded portions 120 and 124 of curve 102 are erroneous excluded from word-1 by the speech system because their frame energies are below noise level threshold 100. Similarly, shaded section 126 is erroneously excluded from word-2 by the frame energy-based method. Shaded section 122 is erroneously included in word-2, because it rises slightly above noise level threshold 100. Hence, it may be seen that significant errors result from relying upon frame energy as the primary means of delineating word boundaries in an input utterance.

In more sophisticated frame energy-based systems, an input utterance, as represented by frame energy curve 102, is segmented into several frames, with each frame typically comprising 20 milliseconds of frame energy curve 102. Noise level threshold 100 may then be adjusted on a frame-by-frame basis such that each frame of an input utterance is associated with a separate noise level threshold. However, even when noise level threshold 100 is adjusted on a frame-by-frame basis, sections of an input utterance (represented by frame energy curve 102) frequently are erroneously included or excluded from a delineated word.

Figure 2A:
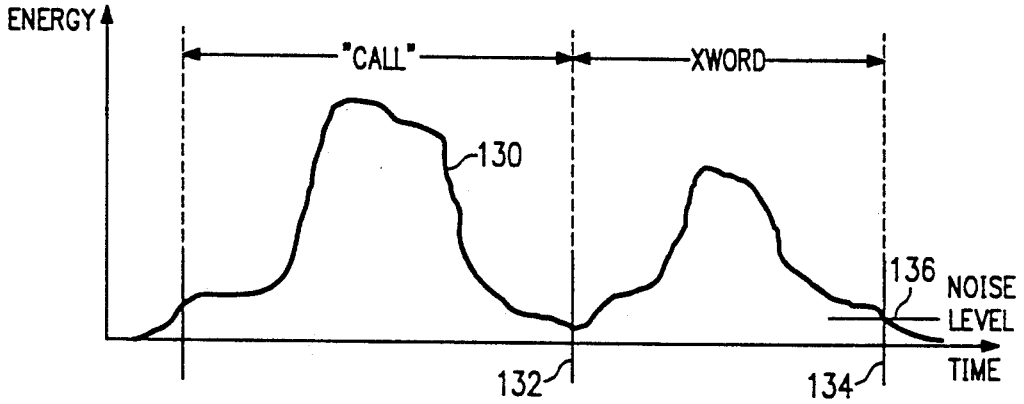
FIGS. 2*a–b* illustrates an embodiment of the present invention using anchor words.

FIG. 2*a* illustrates an embodiment of the present invention which uses an anchor word. The graph in FIG. 2*a* illustrates energy versus time of an input utterance represented by energy curve 130. Under the anchor word approach, a speaker independent anchor word such as "call", "home", or "office" is stored and later used during word enrollment or during subsequent recognition to delineate a word boundary. For example, in word enrollment, a speaker may be prompted to pronounce the word "call" followed by the word to be enrolled. The speaker independent anchor word "call" is then compared against the spoken input utterance to identify a section of energy curve 130 which corresponds to the spoken word "call". Once an appropriate section of energy curve 130 is identified as corresponding with the word "call", an anchor word termination point 132 is established based upon the identified anchor word section of energy curve 130. As shown in FIG. 2*a*, termination point 132 is established immediately adjacent the identified anchor word section of energy curve 130. However, termination point 132 may be based upon the identified anchor word section in other ways such as by placing termination point 132 a specified distance away from the anchor word section. Termination point 132 is then used as the beginning point of the word to be enrolled (XWORD). The termination point of the XWORD to be enrolled may be established at the point 134 where the energy level of curve 130 falls below noise level threshold 136 according to common frame energy-based methods.

Figure 2B:
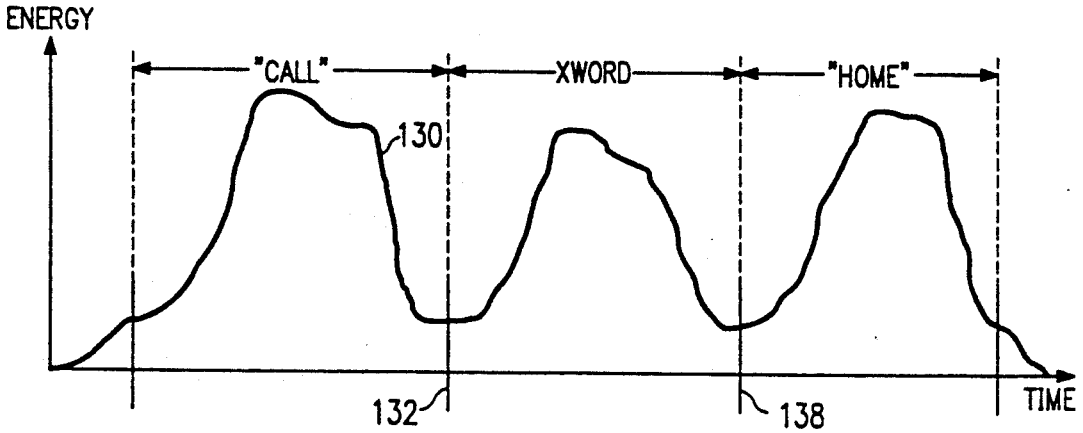

FIG. 2*b* illustrates the use of an anchor word to also delineate the ending point 138 of an enrolled word XWORD. A speaker may be prompted to pronounce the word "home" or "office" after the word to be enrolled. In FIG. 2*b*, the anchor word "home" is identified to correspond with the portion of energy curve 130 beginning at point 138. Hence, the anchor word "call" is used to delineate beginning point 132 of XWORD, while anchor word "home" is used to delineate ending point 138 of XWORD. Under the anchor word approach, speaker-dependent or speaker-adapted anchor words such as "call", "home" and "office" may also be used.

Figure 3:
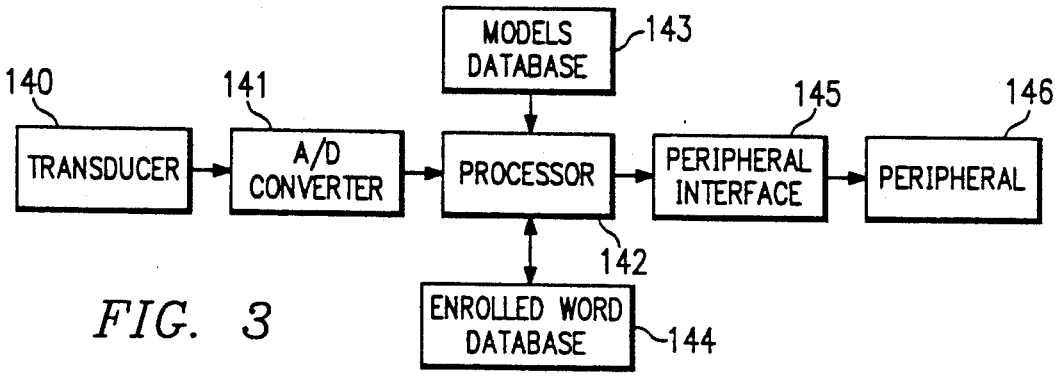
FIG. 3 illustrates an apparatus of the preferred embodiment.

FIG. 3 illustrates a functional block diagram for implementing this embodiment. An input utterance is announced through a transducer 140, which outputs voltage signals to A/D converter 141. A/D converter 141 converts the input utterance into digital signals which are input by processor 142. Processor 142 then compares the digitized input utterance against speaker independent speech models stored in models database 143 to identify word boundaries. Words are identified as existing between the boundaries. In speech enrollment, processor 142 stores the identified speaker dependent words in enrolled word database 144.

In subsequent speech recognition, processor 142 retrieves the words from enrolled word database 144 and models database 143, and processor 142 then compares the retrieved words against the input utterance received from A/D converter 141. After processor 142 identifies words in enrolled word database 144 and in models database 143 which correspond with the input utterance, processor 142 identifies appropriate commands associated with words in the input utterance. These commands are then sent by processor 142 as digital signals to peripheral interface 145. Peripheral interface 145 then sends appropriate digital or analog signals to an attached peripheral 146.

The peripheral commands provided to peripheral interface 145 may comprise telephone dialling commands or phone numbers. For example, a telephone customer may program processor 142 to associate a specified telephone number with a spoken XWORD. To enroll the XWORD, the customer may state the word "call", followed by the XWORD to be enrolled, followed by the word "home", as in "call mom home". Processor 142 identifies boundaries between the three words, segregates the three words and provides them to enrolled word database 144 for storage. In subsequent speech recognition, the telephone customer again states "call mom home". Processor 142 then segregates the three words, correlates the segregated words with data from enrolled word database 144 and models database 143, and associates the correlated words with an appropriate telephone number which is provided to peripheral interface 145.

Transducer 140 may be integral with a telephone which receives dialling commands from an input utterance. Peripheral 146 may be a telephone tone generator for dialling numbers specified by the input utterance. Alternatively, peripheral 146 may be a switching computer located at a central telephone office, operable to dial numbers specified by the input utterance received through transducer 140.

Figure 4:
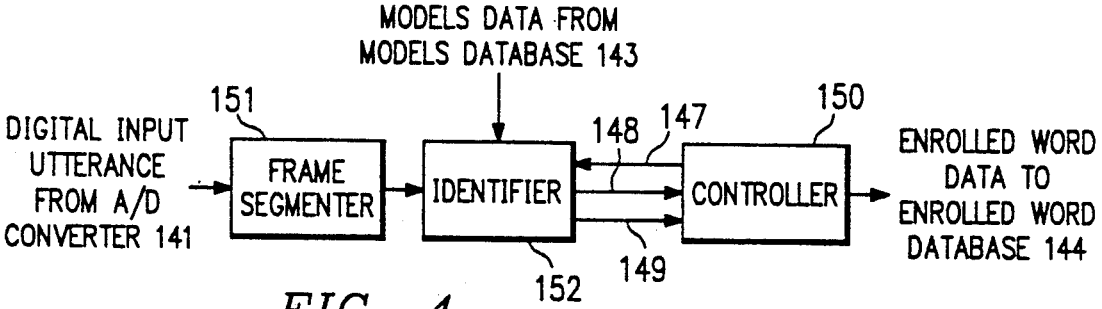
FIG. 4 illustrates an exemplary embodiment of the processor of the apparatus of the preferred embodiment.

FIG. 4 illustrates an exemplary embodiment of processor 142 of FIG. 3 in a configuration for enrolling words in a speech recognition system. A digital input utterance is received from A/D converter 141 by frame segmenter 151. Frame segmenter 151 segments the digital input utterance into frames, with each frame representing, for example, 20 ms of the input utterance. Under the anchor word strategy, identifier 152 compares the input utterance against anchor word speech models stored in models database 143. Recognized anchor words are then provided to controller 150 on connection 143. Under the Null strategy described further hereinbelow, identifier 152 receives the segmented frames, sequentially compares each frame against models data from models database 143, and then sends non-recognized portions of the input utterance to controller 150 via connection 149. Identifier 152 also sends recognized portions of the input utterance to controller 150 via connection 148.

Based on data received from identifier 152 on connections 148 and 149, controller 150 uses connection 147 to specify particular models data from models database 143 with which identifier 152 is to be concerned. Controller 150 also uses connection 147 to specify probabilities that specific models data is present in the digital input utterance, thereby directing identifier 152 to favor recognition of specified models data. Based on data received from identifier 152 via connections 148 and 149, controller 150 specifies enrolled word data to enrolled word database 144.

Under the anchor word strategy, controller 150 uses the identified anchor words to identify word boundaries. If frame energy is utilized to identify additional word boundaries, then controller 150 also analyzes the input utterance to identify points where a frame energy curve crosses a noise level threshold as described further hereinabove in connection with FIGS. 1 and 2*a*.

Based on word boundaries received from identifier 152, and further optionally based upon frame energy levels of digital input utterance, controller 150 segregates words of the input utterance as described further hereinabove in connection with FIGS. 2*a–b*. In speech enrollment, these segmented words are then stored in enrolled word database 144.

Processor 142 of FIGS. 3 and 4 may also be used to implement the Null strategy of the present invention for enrollment. In the Null strategy, the models data from models database 143 comprises noise models for silence, inhalation, exhalation, lip smacking, adaptable channel noise, and other identifiable noises which are not parts of a word, but which can be identified. These types of noise within an input utterance are identified by identifier 152 and provided to controller 150 on connection 148. Controller 150 then segregates portions of the input utterance from the identified noise, and the segregated portions may then be stored in enrolled word database 144.

Figure 5:
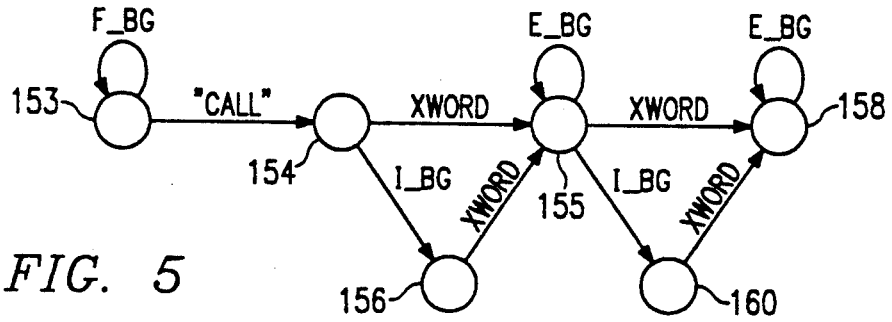
FIG. 5 illustrates a state diagram of the Null strategy.

FIG. 5 illustrates a "hidden Markov Model-based" (HMM) state diagram of the Null strategy having six states. Hidden Markov Modelling is described in "A Model-based Connected-Digit Recognition System Using Either Hidden Markov Models or Templates", by L. R. Rabiner, J. G. Wilpon and B. H. Juang, COMPUTER SPEECH AND LANGUAGE, Vol. I, pp. 167–197, 1986. Node 153 continually loops during conditions such as silence, inhalation, or lip smacking (denoted by F_BG). When a word such as "call" is spoken, state 153 is left (since, the spoken utterance is not recognized from the models data), and flow passes to node 154. The utilization of node 153 is optional, such that alternative embodiments may begin operation immediately at node 154. Also, in another alternative embodiment, the word "call" may be replaced by another command word such as "dial". At node 54, an XWORD may be encountered and stored, in which case control flows to node 155. Alternatively, the word "call" may be followed by a short silence (denoted by I_BG), in which case control flows to node 156. At node 156, an XWORD is received and stored, and control flows to node 155. Node 155 continually loops so long as exhalation or silence is encountered (denoted by E_BG). When neither exhalation nor silence is encountered at node 155, if an XWORD is immediately encountered, control flows to node 158 which stores the XWORD. Alternatively, if a short silence (I_BG) precedes the XWORD, then control flows to node 160. At node 160, the XWORD is received and stored, and control flows to node 158. Node 158 then continually loops while exhalation or silence is encountered. By using the Null strategy for enrollment, a variable number of XWORDs may be enrolled, such that a speaker may choose to enroll one or more words during a particular enrollment. I-BG and E-BG may optionally represent additional types of noise models, such as models for adapted channel noise, exhalation, or lip-smacking.

Figure 6A:
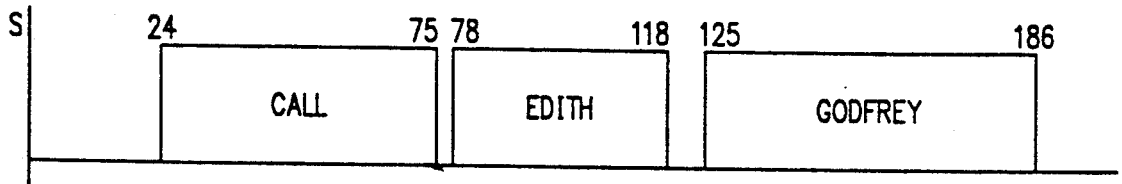
FIG. 6 illustrate the frame-by-frame analysis utilized by the Null strategy.

FIGS. 6*a–e* illustrate the frame-by-frame analysis utilized by the Null strategy of the preferred embodiment. FIG. 6*a* illustrates a manual determination of starting points and termination points for three separate words in an input utterance. As shown in FIG. 6*a*, the word "call" begins at frame 24 (time=24 × 20 ms) and terminates at frame 75. The word "Edith" begins at frame 78 and terminates at frame 118. The word "Godfrey" begins at frame 125 and terminates at frame 186.

In FIGS. 6*b–e*, each frame (20 ms) of the input utterance is separately analyzed and compared against models stored in a database. Examples of such models include inhalation, lip smacking, silence, exhalation and short silence of a duration, for example, between 20 ms and 400 ms. Each frame either matches or fails to match one of the models. A variable recognition index (N) may be established, and each recognized frame may be required to achieve a recognition score against a particular model which meets or exceeds the specified recognition index (N). The determination of a recognition score is described further in U.S. Pat. No. 4,977,598, by Doddington et al., entitled "Effective Pruning Algorithm For Hidden Markov Model Speech Recognition", which is incorporated by reference herein.

Figure 6B:
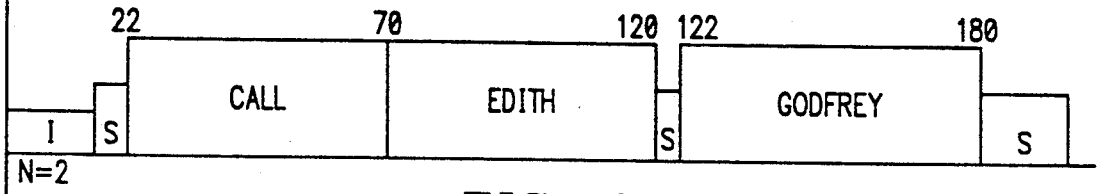

In FIG. 6*b*, a recognition index of N=2 is established. As shown, frames 1–21 sufficiently correlated with models for inhalation ("Inhale") and silence ("S"), but frames 22–70 were not sufficiently recognized when compared against the models. Similarly, frames 70–120 are not sufficiently recognized to satisfy the recognition index of N=2. Consequently, frames 71–120 are identified as being an XWORD which, in this case, is "Edith".

The delineation of separate words between frames 70 and 71 is established by identifying the anchor word "call" within frames 22–120 in accordance with the anchor word strategy described further hereinabove in connection with FIGS. 2–4. However, the Null strategy does not require the use of anchor words. In fact, the Null strategy successfully delineates the boundary between the XWORDs "Edith" and "Godfrey" without the assistance of anchor words by identifying a recognized noise frame 121 as being silence which satisfies the recognition index of N=2 when compared against the speech models. Frame 121 is recognized as a word boundary because it separates otherwise continuous chains of non-recognized frames. Moreover, the Null strategy may be implemented to require a minimum number of continuous non-recognized frames prior to recognizing a continuous chain of non-recognized frames as being an XWORD. Frames 122–180 are not recognized and hence are identified as being an XWORD which, in this case, is "Godfrey". Frames 181 forward are recognized as being silence.

For FIGS. 6*b–e*, without using the anchor word analysis to delineate "call" and "Edith", the phrase "call Edith" would be stored as a single word during enrollment. This problem can be solved by prompting the speaker to immediately state the XWORD (e.g., "Edith") to be enrolled, without prefacing the XWORD with a command word (e.g., "call"). Consequently, the Null strategy does not require the use of anchor words.

Figure 6C:
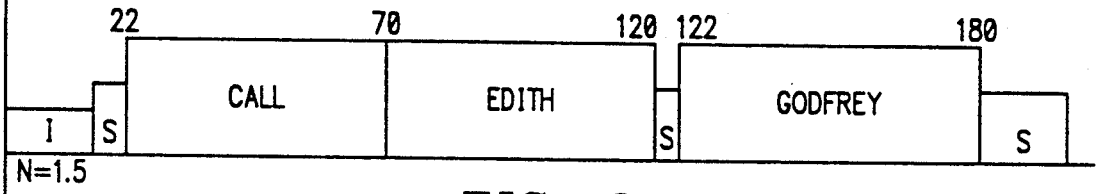
Figure 6D:
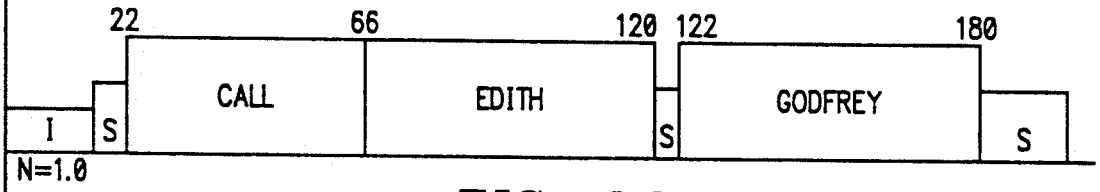
Figure 6E:
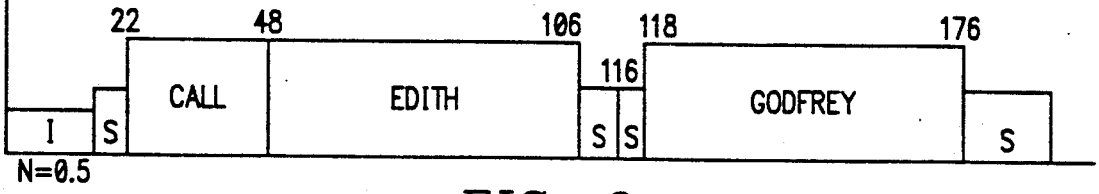

FIGS. 6*c–e* illustrate comparisons using different recognition indices. As shown, the recognition index of N=1.5 in FIG. 6*c* appears to closely match the delineated beginning and termination frames for the three words "call", "Edith" and "Godfrey" when compared against the manually delineated boundaries of FIG. 6*a*.

FIG. 6*e* illustrates the use of a very stringent recognition index of 0.5, which requires a stronger similarity before frames are recognized when compared against the models. For example, frame 121 is mistakenly classified as part of a word rather than as noise, because frame 121 is no longer recognized as silence when compared against the speech models using a recognition index of N=0.5. Moreover, the word "call" is recognized as only corresponding to frames 22–48 (rather than frames 22–70 as shown in FIGS. 6*b–c*) due to the more stringent index of N=0.5. Similarly, the word "Edith" is recognized as ending at frame 106 (rather than at frame 120 as shown in FIGS. 6*b–d*) due to the more stringent index of N=0.5, which also results in frames 107–117 being alternately classified as silence ("S") because the fricative portion "th" of "Edith" is no longer recognized as corresponding to frames 107–120.

Conversely, the recognition index (N) should not be overly lenient, thereby requiring a lower degree of similarity between the analyzed frame and the speech models, because parts of words may improperly be identified as noise and therefore would be improperly excluded from being part of an enrolled XWORD.

In comparison with previous approaches, the Null strategy, especially when combined with anchor words, is quite advantageous in dealing with words that flow together easily, in dealing with high noise either from breathe or from channel static, and in dealing with low energy fricative portions of words such as the "X" in the word "six" and the letter "S" in the word "sue". Fricative portions of words frequently complicate the delineation of beginning and ending points of particular words, and the fricative portions themselves are frequently misclassified as noise. However, the Null strategy of the preferred embodiment successfully and properly classifies many fricative portions as parts of an enrolled word, because fricative portions usually fail to correlate with Null strategy noise models for silence, inhalation, exhalation and lip smacking.

The Null strategy of the preferred embodiment successfully classifies words in an input utterance which run together and which fail to be precisely delineated. Hence, more words may be enrolled in a shorter period of time, since long pauses are not required by the Null strategy.

The anchor word approach or the Null strategy approach may each be used in conjunction with Hidden Markov Models or with dynamic time warping (DTW) approaches to speech systems.

In one speech recognition test, a frame energy-based enrollment strategy produced approximately eleven recognition errors for every one hundred enrolled words. In the same test, the Null strategy enrollment approach produced only approximately three recognition errors for every one hundred enrolled words. Consequently, the Null strategy of the preferred embodiment offers a substantial improvement over the prior art.

Although the present invention and its advantages have been described in detail, it should be understood that various changes, substitutions and alterations can be made herein without departing from the spirit and scope of the invention as defined by the appended claims.

What is claimed is:

1. Apparatus for identifying one or more boundaries of a speech pattern within an input utterance, comprising:

circuitry for defining one or more anchor patterns;

circuitry for receiving the input utterance;

circuitry for identifying a beginning and an end of an anchor section of the input utterance, said anchor section corresponding to at least one of said anchor patterns; and circuitry for defining one boundary of the speech pattern based upon said anchor section, wherein said boundary defining circuitry comprises circuitry for defining a start boundary of the speech pattern at the end of said anchor section.

2. The apparatus of claim 1 and further comprising circuitry for defining a stop boundary of the speech pattern at a point in the input utterance where an energy level is below a predetermined level.

3. The apparatus of claim 1 wherein said defining circuitry comprises circuitry for defining a stop boundary of the speech pattern at the beginning of said anchor section.

4. The apparatus of claim 1 and further comprising circuitry for defining a start boundary of the speech pattern at a point in the input utterance where an energy level is above a predetermined level.

5. The apparatus of claim 1 and further comprising circuitry for prompting a speaker to utter at least a predetermined one of said anchor patterns before speaking the speech pattern.

6. The apparatus of claim 1 and further comprising circuitry for prompting a speaker to utter at least a predetermined one of said anchor patterns after speaking the speech pattern.

7. The apparatus of claim 1 wherein said anchor pattern defining circuitry comprises circuitry for defining one or more speaker independent anchor patterns.

8. The apparatus of claim 1 and further comprising circuitry for identifying the speech pattern by comparing the speech pattern with a previously stored speech pattern.

9. The apparatus of claim 8 and further comprising circuitry for identifying the speech pattern by comparing the speech pattern with a previously stored speaker dependent speech pattern.

10. The apparatus of claim 8 and further comprising circuitry for controlling a device responsive to said identified speech pattern.

11. Apparatus for identifying a speech pattern within an input utterance, comprising:

circuitry for defining one or more segment patterns, wherein said segment patterns comprise noise patterns;

circuitry for receiving an input utterance;

circuitry for identifying portions of said utterance which correspond to said segment patterns; and circuitry for defining one or more segments of said input utterance responsive to said identified portions.

12. The apparatus of claim 11 wherein one of said segment patterns comprise a lip smack noise pattern.

13. The apparatus of claim 11 wherein one of said segment patterns comprises a silence pattern.

14. The apparatus of claim 11 wherein one of said segment patterns comprises an inhalation noise pattern.

15. The apparatus of claim 11 wherein one of said segment patterns comprises an exhalation noise pattern.

16. The apparatus of claim 11 wherein said defined segments of said input utterance comprise portions of said input utterance which fail to correspond to said segment patterns.

17. The apparatus of claim 11 and further comprising circuitry for defining one or more segment groups each comprising one or more segments that are uninterrupted in said input utterance by one of said identified portions.

18. The apparatus of claim 17 and further comprising circuitry for defining the speech pattern as comprising one or more of said segment groups.

19. The apparatus of claim 18 wherein said speech pattern defining circuitry comprises circuitry for excluding from the speech pattern any segment group that fails to have a minimum size.

20. The apparatus of claim 11 wherein said identifying circuitry comprises circuitry for comparing one or more elements of said input utterance against one or more of said segment patterns.

21. The apparatus of claim 11 wherein said segment pattern defining circuitry comprises circuitry for modelling said segment patterns based on a Hidden Markov Model.

22. The apparatus of claim 11 and further comprising circuitry for prompting a speaker to utter said input utterance.

23. The apparatus of claim 11 wherein said segment pattern defining circuitry comprises circuitry for establishing one or more speaker independent segment patterns 24. The apparatus of claim 11 and further comprising circuitry for identifying the speech pattern by comparing the speech pattern with a previously stored speech pattern.

25. The apparatus of claim 24 and further comprising circuitry for identifying the speech pattern by comparing the speech pattern with a previously stored speaker dependent speech pattern.

26. The apparatus of claim 24 and further comprising circuitry for controlling a device responsive to said identified speech pattern.

27. A method for identifying one or more boundaries of a speech pattern within an input utterance, comprising the steps of:

defining one or more anchor patterns;

receiving the input utterance;

identifying a beginning and an end of an anchor section of the input utterance, said anchor section corresponding to at least one of said anchor patterns; and defining one boundary of the speech pattern based upon said anchor section, wherein said boundary defining step comprises the step of defining a start boundary of the speech pattern at the end of said anchor section.

28. The method of claim 27 and further comprising the step of defining a stop boundary of the speech pattern at a point in the input utterance where an energy level is below a predetermined level.

29. The method of claim 27 wherein said defining step comprises the step of defining a stop boundary of the speech pattern at the beginning of said anchor section.

30. The method of claim 27 and further comprising the step of defining the start boundary of the speech pattern at a point in the input utterance where an energy level is above a predetermined level.

31. The method of claim 27 and further comprising the step of prompting a speaker to utter at least a predetermined one of said anchor patterns before speaking the speech pattern.

32. The method of claim 27 and further comprising the step of prompting a speaker to utter at least a predetermined one of said anchor patterns after speaking the speech pattern.

33. The method of claim 27 wherein said anchor pattern defining step comprise the step of defining one or more speaker independent anchor patterns.

34. The method of claim 27 and further comprising the step of identifying the speech pattern by comparing the speech pattern with a previously stored speech pattern.

35. The method of claim 34 and further comprising the step of identifying the speech pattern by comparing the speech pattern with a previously stored speaker dependent speech pattern.

36. The method of claim 34 and further comprising the step of controlling a device in response to said identified speech pattern.

37. A method for identifying a speech pattern within an input utterance, comprising the steps of:

defining one or more segment patterns, wherein said segment patterns defining step comprises the step of defining one or more noise patterns;

receiving an input utterance;

identifying portions of said input utterance which correspond to said segment patterns; and defining one or more segments of said input utterance responsive to said identified portions.

38. The method of claim 37 wherein said segments defining step comprises the step of identifying portions of said input utterance which fail to correspond to said segment patterns.

39. The method of claim 37 and further comprising the step of defining one or more segment groups each comprising one or more segments that are uninterrupted in said input utterance by one of said identified portions.

40. The method of claim 39 and further comprising the step of defining the speech pattern as comprising one or more of said segment groups.

41. The method of claim 40 wherein said speech pattern defining step comprises the step of excluding from the speech pattern any segment group that fails to have a minimum size.

42. The method of claim 37 wherein said identifying step comprises the step of comparing one or more elements of said input utterance against one or more of said segment patterns.

43. The method of claim 37 wherein said segment pattern defining step comprises the step of modelling said segment patterns based on a Hidden Markov Model.

44. The method of claim 37 and further comprising the step of prompting a speaker to utter said input utterance.

45. The method of claim 37 wherein said segment pattern defining step comprises the step of establishing one or more speaker independent segment patterns.

46. The method of claim 37 and further comprising the step of identifying the speech pattern by comparing the speech pattern with a previously stored speech pattern.

47. The method of claim 46 and further comprising the step of identifying the speech pattern by comparing the speech pattern with a previously stored speaker dependent speech pattern.

48. The method of claim 46 and further comprising the step of controlling a device in response to said identified speech pattern.

49. A system for enrolling a predetermined speech pattern in a speech recognition system, comprising:

circuitry for defining one or more anchor patterns;

circuitry for receiving an input utterance;

circuitry for identifying a beginning and an end of one or more anchor sections of said input utterance, said anchor sections corresponding to at least one of said anchor patterns;

circuitry for defining one or more boundaries of the predetermined speech pattern to be adjacent said anchor sections within said input utterance, wherein said boundary defining circuitry comprises circuitry for defining a start boundary of the speech pattern at the end of said anchor section; and circuitry for storing the predetermined speech pattern.

50. The system of claim 49 and further comprising circuitry for defining a stop boundary of the predetermined speech pattern at a point in the input utterance where an energy level is below a predetermined level.

51. The system of claim 49 wherein said defining circuitry comprises circuitry for defining a stop boundary of the predetermined speech pattern at the beginning of said anchor section.

52. The system of claim 49 and further comprising circuitry for defining a start boundary of the predetermined speech pattern at a point in the input utterance where an energy level is above a predetermined level.

53. A system for enrolling a specific speech pattern in a speech recognition system, comprising:

circuitry for defining one or ore segment patterns;

circuitry for receiving an input utterance;

circuitry for defining one or more segments of said input utterance, said defined segments comprising portions of said input utterance which fail to correspond to said segment patterns;

circuitry for defining the specific speech pattern as comprising one or more of said segments, wherein said specific speech pattern defining circuitry comprises circuitry for excluding from the speech pattern any segment group that fails to have a minimum size; and circuitry for storing the specific speech pattern.

54. The system of claim 53 and further comprising circuitry for defining one or more segment groups each comprising one or more segments that are uninterrupted in said input utterance by one of said portions.

55. The system of claim 54 and further comprising circuitry for defining the speech pattern as comprising one or more of said segment groups.

56. A system for controlling a device responsive to a speech pattern within an input utterance, comprising:

circuitry for determining a speech pattern;

circuitry for defining one or more anchor patterns;

circuitry for receiving the input utterance;

circuitry for identifying one or more anchor sections of the input utterance, said anchor sections corresponding to at least one of said anchor patterns;

circuitry for defining one or more boundaries of said speech pattern to be adjacent said anchor sections within the input utterance, wherein said boundary defining circuitry comprises circuitry for defining a start boundary of said speech pattern at the end of said anchor section; and circuitry for associating said speech pattern with a function of the device.

57. The system of claim 56 and further comprising circuitry for defining a stop boundary of said speech pattern at a point in the input utterance where an energy level is below a predetermined level.

58. The system of claim 56 wherein said defining circuitry comprises circuitry for defining a stop boundary of said speech pattern at the beginning of said anchor section.

59. The system of claim 56 and further comprising circuitry for defining the start boundary of said speech pattern at a point in the input utterance where an energy level is above a predetermined level.

60. A system for controlling a device responsive to a speech pattern, comprising:

circuitry for determining a speech pattern;

circuitry for defining one or more segment patterns;

circuitry for receiving an input utterance;

circuitry for defining one or more segments of said input utterance, said defined segments comprising portions of said input utterance which fail to correspond to said segment patterns;

circuitry for defining said speech pattern as comprising one or more of said segments;

circuitry for defining one or ore segment groups, each said segment group comprising one or more segments that are uninterrupted in said input utterance by one of said portions; and circuitry for associating said speech pattern with a function of the device.

61. The system of claim 60 and further comprising circuitry for defining said speech pattern as comprising one or more of said segment groups.

62. The system of claim 61 wherein said speech pattern defining circuitry comprises circuitry for excluding from the speech pattern any segment group that fails to have a minimum size.

* * * * *